United States Patent [19]

Morell

[11] Patent Number: 4,753,480

[45] Date of Patent: Jun. 28, 1988

[54] PAD ASSEMBLY FOR WHEELCHAIRS

[76] Inventor: Theodore R. Morell, 59-29 174th St., Fresh Meadows, N.Y. 11365

[21] Appl. No.: 50,202

[22] Filed: May 14, 1987

Related U.S. Application Data

[63] Continuation-in-part of Ser. No. 896,631, Aug. 14, 1986, Pat. No. 4,682,818.

[51] Int. Cl.[4] ..... A47C 7/02

[52] U.S. Cl. ..... 297/452; 5/437; 5/464; 5/DIG. 2; 297/458; 297/459; 297/DIG. 2

[58] Field of Search ..... 297/458, 459, 452, 455, 297/DIG. 2; 5/DIG. 2, 436, 437, 442, 458, 459, 464, 465, 481

[56] References Cited

U.S. PATENT DOCUMENTS

| | | | |
|---|---|---|---|
| 2,933,738 | 4/1960 | Whelan | 5/436 |
| 3,742,528 | 7/1973 | Munch | 5/464 |
| 3,833,259 | 9/1974 | Pershing | 5/464 |
| 3,987,507 | 10/1976 | Hall | 5/437 |
| 4,053,957 | 10/1977 | Regan | 5/464 |
| 4,132,228 | 1/1979 | Green | 297/459 X |
| 4,161,045 | 7/1979 | Regan | 5/464 |
| 4,290,155 | 9/1981 | Hanson | 5/465 |
| 4,476,594 | 10/1984 | McLeod | 5/464 |
| 4,606,580 | 8/1986 | Yoshizawa | 297/458 |

FOREIGN PATENT DOCUMENTS

| | | | |
|---|---|---|---|
| 2016918 | 9/1979 | United Kingdom | 5/464 |

*Primary Examiner*—James T. McCall

*Attorney, Agent, or Firm*—Amster, Rothstein & Ebenstein

[57] ABSTRACT

A modifiable pressure distribution pad assembly for a wheelchair comprises a bottom pad of resilient foam material of high density and at least one upper pad of resilient foam material of intermediate density having at least one cutout defining an opening therethrough. Filler foam material of low density is frictionally mounted as an insert in at least one of the openings of one of the upper pads and removable therefrom. A cover encloses the pads, the cover permitting removal of the upper pads and associated filler material therefrom so that filler foam material in one opening can be separated from the upper pads and replaced in the one opening by filler foam material of a different density prior to return of the upper pads and associated filler foam material to the cover. A kit for preparing a modifiable assembly includes in addition, for at least one of the openings, a plurality of inserts of filler foam material adapted to be removably mounted in the opening, the inserts being of filler foam material having different low densities from each other.

9 Claims, 3 Drawing Sheets

Fig. 2.
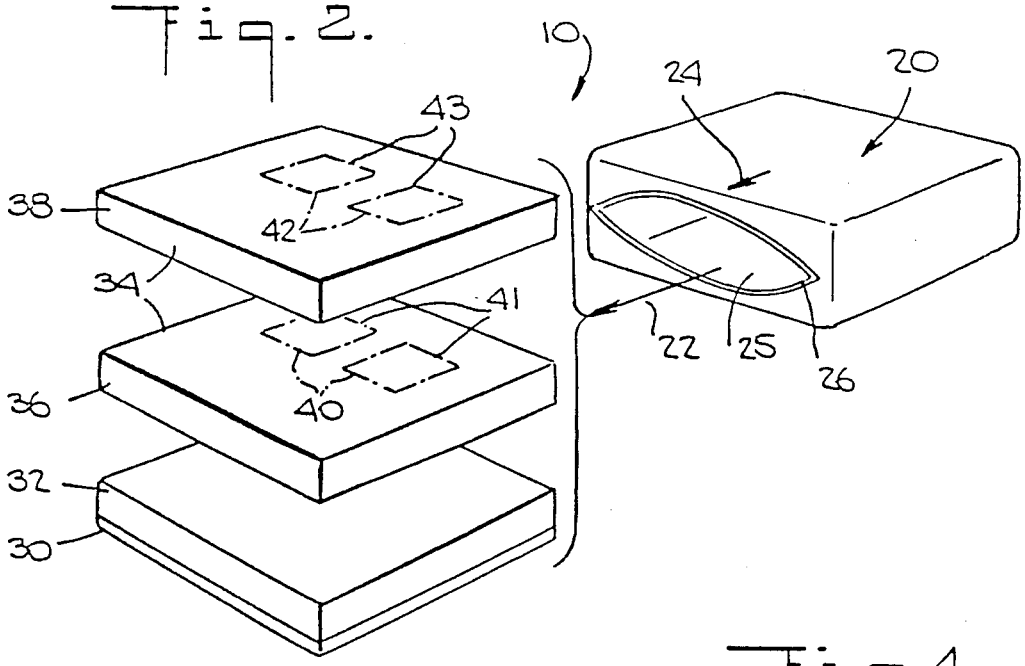
Fig. 3.
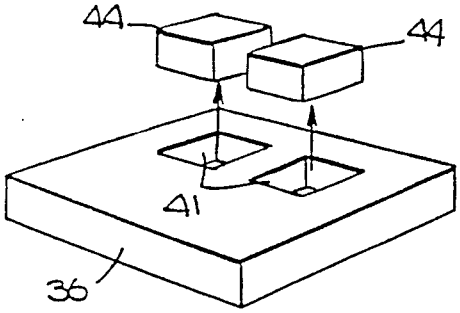
Fig. 4.
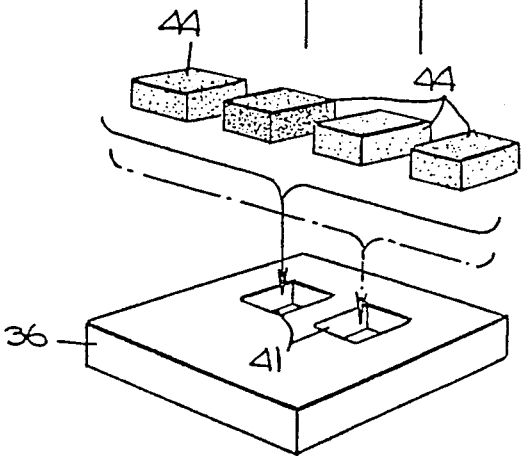
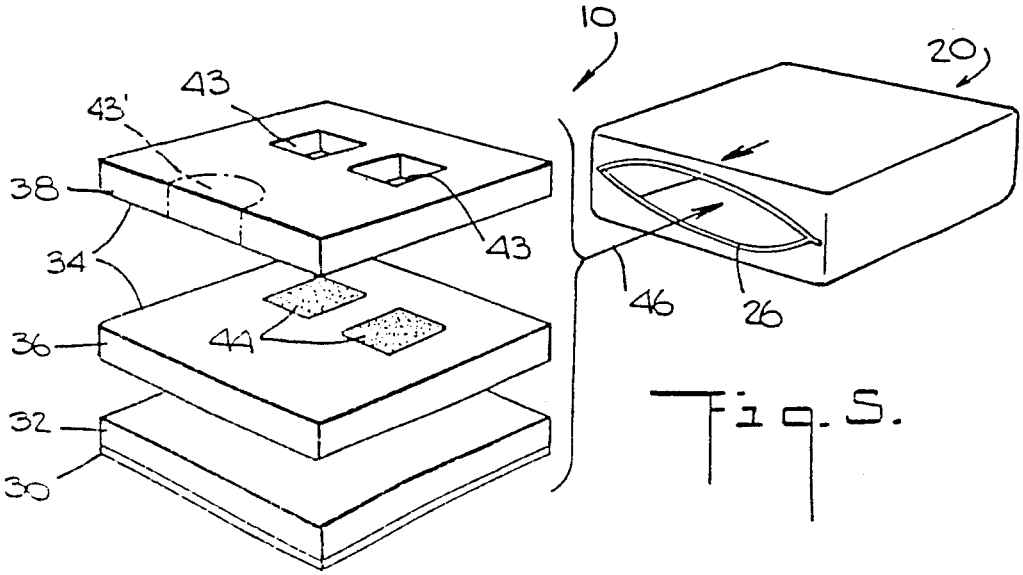
Fig. 5.

PAD ASSEMBLY FOR WHEELCHAIRS

CROSS-REFERENCE TO RELATED APPLICATIONS

The present application is a continuation-in-part of application Ser. No. 896,631, filed Aug. 14, 1986, now U.S. Pat. No. 4,682,818.

BACKGROUND OF THE INVENTION

The present invention relates generally to seat pads and more particularly to an improved pressure distribution pad for wheelchairs.

Conventional seat pads are often made from a generally solid material such as foam rubber or an equivalent plastic foam material. Less solid pads have incorporated a gel material or similar semi-viscous substance. Still less solid pads have included liquid filling the entire pad or disposed in individual compartments thereof. While these pads provide more comfort than a flat hard surface to a person seated thereon, there still does not result a desired type of support in that the reaction of the pad is uniform over the entire surface and the seated individual tends to shift or roll from side to side or from forward to rearward positions. Thus there is a certain degree of "instability."

To overcome this problem, it has been proposed to provide pads which are contoured and which are made of compositions which have a "memory". In both instances, it is usually required that the seated individual remain in the same position all the time in order to realize the best pressure distribution. In other words, the pressure points must remain within the contoured areas if the pad is to be effective.

Hall, U.S. Pat. No. 3,987,507, describes a pad assembly of resilient foam material having interior cutout portions at locations corresponding to those locations at which maximum pressures are typically exerted by a person seated on the pad assembly. These cutout portions are filled with a foam material of lesser density than the remainder of the pad assembly. Unlike those pads utilizing liquids, semi-vicous gel materials or simple foam rubber or plastic foam, the design of this resilient foam pad is such that there is no tendency to develop shear forces or for a patient to "roll" on the pad. Thus the design is such that the patient is not only "stable", but the patient is not confined to one position as would occur with a contoured cushion or one of the type incorporating a memory pad.

However, the Hall pad assembly has not proven to be entirely satisfactory in use. First, the density of the filler foam material placed in the interior cutout portions at the factory may not be the most suitable for use in those particular positions for particular patients. Second, even when the filler foam material placed in the interior cutout portions was of the most suitable density for a particular patient at the original time of usage of the assembly, as the patient's body undergoes changes over time that particular density at a later date may no longer be the most suitable. For example, the patient's weight may vary radically, bedsores or other skin irritations may appear or disappear, the amount of time that the patient will spend on the pad daily may vary, etc. Thus the need remains for a pad assembly of resilient foam material which can be manufactured so as to provide an initial customized level of support within the interior cutout portions and which can easily be modified as required over time, without return to the factory, so as to provide a different level of support within one or more of the interior cutout portions.

Accordingly, it is an object of the present invention to provide a pressure distribution pad assembly in which the density of the filler foam material in the interior cutout portions may easily be varied initially after receipt from the factory to meet the particular needs of the individual user.

Another object is to provide such an assembly in which the density of the filler foam material in the interior cutout portioms may easily be varied over time, without return to the factory, in order to meet the changing requirements of the individual user.

A further object is to provide a kit from which such assemblies can be easily constructed and modified outside of the factory.

It is also an object to provide a pressure distribution pad which, by varying the foam density in different sections, helps control posture.

SUMMARY OF THE INVENTION

It has now been found that the above and related objects of the present invention are obtained in a modifiable pressure distribution pad assembly for a wheelchair comprising a bottom pad, at least one upper pad and a cover enclosing both of the pads. The upper pad is supported by the bottom pad and has at least one cutout defining an opening therethrough. Filler foam material is frictionally mounted as an insert in at least one of the openings of one of the upper pads and is removable therefrom. The cover permits removal of the upper pad and associated filler foam material therefrom so that the filler foam material in one opening can be separated from the upper pad and replaced in that opening by filler foam material of a different density prior to return of the upper pad and associated filler foam material to the cover. The bottom or anti-bottoming-out pad is formed of a resilient foam material of high density; the upper pad, of a resilient foam material of an intermediate density less than the high density. The filler foam materials used as inserts have low densities less than the intermediate density.

Preferably, the openings and the inserts are configured and dimensioned for frictional retention of the inserts in the openings. The inserts and openings are typically rectangular, preferably square, in configuration but may be of any configuration.

In a preferred embodiment, the assembly additionally includes a substantially inflexible foundation or anti-hammocking panel disposed beneath the bottom pad, the cover enclosing both the panel and the pads. Typically, the filler has manually operable closure means such as a slide fastener.

Another embodiment of the present invention comprises a kit for preparing an individualized and modifiable pressure distribution pad assembly for a wheelchair. The kit includes the aforementioned pad assembly elements (i.e., the bottom pad, at least one upper pad having at least one cutout defining an opening therethrough, and the cover adapted to enclose the pads) and, for each of at least one of the openings of the upper pad, a plurality of inserts of filler foam material adapted to be removably mounted in the opening. The inserts are formed of filler foam material having different low densities from each other.

Thus, the kit embodiment of the present invention not only enables the patient to initially construct a pad assembly wherein the openings of the upper pad are filled with the most appropriate filler foam material for that particular patient, but furthermore enables the patient at any given time in the future to easily replace the filler foam material in one or more of the openings with a filler foam material of a different density so as to modify the pad assembly to take into consideration the patient's changed physical circumstances.

An improved embodiment of the modifiable pressure distribution pad assembly for a wheelchair comprises a bottom pad, at least one upper pad and a cover enclosing both of the pads. The upper pad is supported by the bottom pad and has at least one cutout defining an opening therethrough. A fluid-tight pouch, at least partially filled with fluid, is frictionally mounted as an insert in at least one of the openings of at least one of the upper pads and is removable therefrom. The cover permits removal of the upper pad and associated pouch insert therefrom so that the pouch insert in the opening can be separated from the upper pad, the amount of fluid in the pouch insert varied to modify the firmness thereof, and the pouch insert replaced in the opening prior to return of the upper pad and associated pouch insert to the cover. The anti-bottoming out or bottom pad is formed of resilient foam material of high density; the upper pad, of resilient foam material of an intermediate density less than said high density. The pouch insert has a firmness less than that of the upper pad.

The fluid may be selected from the group consisting of air, water, gel and mixture thereof, and the pouch insert contains manually operable valve means to permit the introduction, maintenance and removal of the fluid relative to the pouch insert.

Preferably in the improved embodiment filler foam material is frictionally mounted as an insert in the opening with the pouch insert and removable therefrom, the filler foam material having a low density less than said intermediate density. The pouch insert, when substantially filled with fluid, and the filler foam material insert have combined heights enabling both inserts to be received one atop the other within the opening. The cover permits removal of the upper pad and associated inserts therefrom so that the inserts in the opening can be separated from the upper pad and replaced in the opening by inserts of a different effective combined firmness prior to return of the upper pad and associated inserts to the cover.

Another improved embodiment of the present invention comprises a kit for preparing an individualized and modifiable pressure distribution pad assembly for a wheelchair. The kit comprises a bottom pad of resilient foam material of high density and at least one upper pad of resilient foam material of an intermediate density less than the high density, the upper pad having at least one cutout defining an opening therethrough and being adapted to be supported by the bottom pad. For such opening, there are a plurality of inserts adapted to be removably mounted therein, at least one of the inserts being of filler foam material having a low density less than the intermediate density, and at least one of the inserts being a fluid-tight pouch adapted to be filled with fluid. A cover is adapted to enclose the pads, the cover permitting insertion into and removal from the cover of the upper pad and those of the inserts mounted in the openings thereof.

The pouch insert and the filler foam material insert preferably have heights enabling both the pouch insert, when substantially filled with fluid, and the filler foam material insert to be received one atop the other within the opening. The filler foam material insert may be the original cutout.

BRIEF DESCRIPTION OF THE DRAWINGS

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 2 is an exploded isometric view of the pad assembly showing the various pads and panel being removed from the cover and with cutout portions being indicated in phantom-line;

FIG. 3 is an isometric view of the upper pad with an insert being removed from each opening therein;

FIG. 4 is an isometric view of the upper pad with one of four inserts of differing low densities being inserted in each of the openings therein;

FIG. 5 is an exploded isometric view of the pad assembly showing the various pads, panel and associated inserts being returned to the cover;

DETAILED DESCRIPTION OF THE PREFERRED EMBODIMENTS

Figure 1:
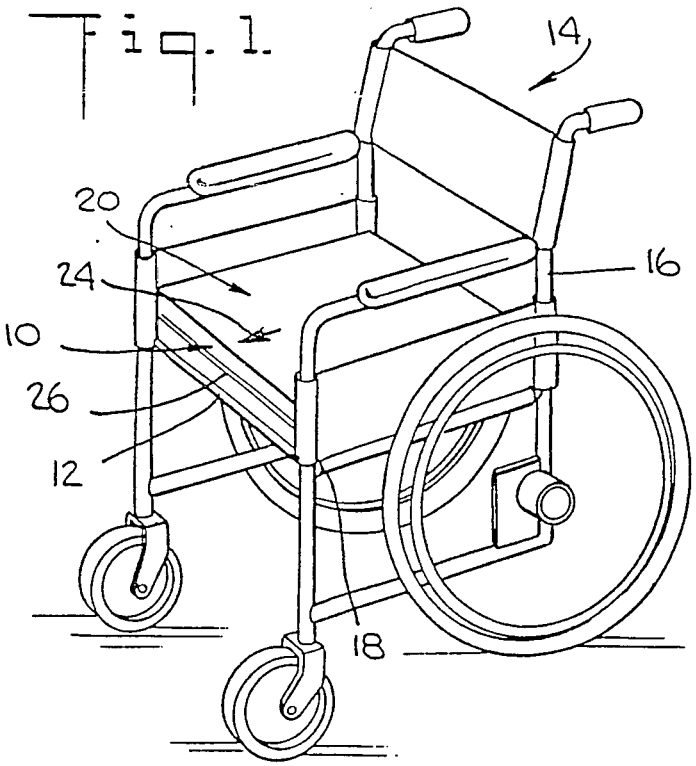
FIG. 1 is an isometric view of a wheelchair on which rests a modifiable pressure distribution pad assembly of the present invention.

Referring to the drawing and in particular to FIG. 1 thereof, therein illustrated is a pressure distribution pad assembly, generally designated by the reference numeral 10, constructed in accordance with the present invention and resting on the flexible seat 12 of a conventional collapsible wheelchair generally designated 14. The wheelchair 14 includes the normal tubular framework 16, including a spaced pair of horizontal tubular members 18 which support the fabric of seat 12.

Referring now to FIG. 2, therein illustrated is a cover, generally designated by the numeral 20, from which a variety of pads and a panel are being removed, as shown by the arrow 22. The cover 20 is typically rectangular or square in order to snugly fit within the seating area of the wheelchair as defined by the horizontal tubular members 18 and the width of the flexible seat 12. The proper orientation of the pad assembly is indicated by an arrow 24 disposed adjacent the front margin of the upper surface of the cover. If desired, other means may be used to indicate the appropriate orientation of the pad assembly 10; for example, the rear of the pad assembly (including the cover and the various pad and panel elements disposed within the cover) may be slightly bowed convexly to the rear. The cover defines an aperture 25 on the front thereof of sufficient size to enable removal from the cover of the various pads and panel and is provided with manually operable closure means 26 for the aperture 25, such as a zipper or Velcro fasteners. While the aperture 25 and closure means 26 are shown as disposed on the front surface of the cover 20, clearly they could be disposed on other surfaces such as the rear or side of the cover instead. The cover is preferably made from a material which is anti-bacterial, flame-retardent, anti-static, self-deodorizing, stain-resistant, fluid-proof, non-allergenic and long-lasting.

Typically disposed within the cover 20 are, in sequence from bottom to top, a substantially inflexible anti-hammocking board or foundation panel 30, a bottom pad 32 of resilient foam material of high density, and at least one upper pad 34 of a resilient foam material of an intermediate density less than the high density. In the illustrated embodiment there are two upper pads 34, a bottom upper pad which for the sake of convenience we will refer to as the intermediate pad 36, and a top upper pad which we shall for convenience refer to as the top pad 38. As indicated, the top pad 38 rests on the intermediate pad 36 which in turn rests on the bottom pad 32, which is in turn supported by the foundation panel 30.

The inflexible foundation panel 30 acts as an anti-hammocking device and negates the tendency of all wheelchair seats (especially flexible wheelchair seats) to hammock or sink towards the center of the seat when used, thereby undesirably transferring some of the pressure from the buttocks and thighs of the patient to the hip bones. The foundation panel is typically a rigid panel preferably of tempered masonite reinforced with steel edging.

Much as the foundation panel 30 acts as an anti-hammocking device, the bottom pad 32 acts as an anti-bottoming device. Except for the seats which contain fluid materials such as water, gel or air, most other seats "bottom out"—i.e., in use over time, the seat reaches a point where the various foams offer no resistance and the buttocks therefore rest upon a hard surface (such as the foundation panel 30). Accordingly, the bottom pad 32 is formed of a very firm resilient foam material of high density so as to provide at least some cushioning effect, regardless of the weight placed on it. Bonded foams, especially those with a density of about 6 lbs/ft$^3$, are particularly suited for this pad.

The intermediate pad 36 is formed of a resilient foam material of an intermediate density less than the high density of the bottom pad 32 and is provided with one or more cutout portions 40 extending therethrough, each of the two cutout portions 40 (shown in phantom-line) leaving an opening 41. As illustrated, for the sake of simplicity, one square opening 41 is provided for each check of the buttocks, in actual practice the number, position and size of the openings 41 will typically be determined by a doctor or rehabilitation specialist on the basis of the needs of the patient at the time that the pad assembly is ordered. The openings 41 are preferably square or at least rectangular, rather than circular, so as to provide corners for reasons which will become apparent later. Generally cutouts of 2 by 4, 3 by 4, or 4 by 4 inches are employed.

Like the intermediate pad 36, the top pad 38 is formed of a resilient foam material of intermediate density and is provided with one or more cutout portions 42 (two being shown in phantom-line) defining openings 43. While the openings 43 of this upper pad 38 will typically be aligned vertically with the openings 41 of the other upper pad 36, in particular instances other arrangements may be desirable.

Also provided in a kit with the cover 20, foundation panel 30, bottom pad 32 and at least one upper pad 34 are a plurality of inserts 44, as shown in FIG. 4. A plurality of the inserts 44 are preferably provided for each opening 41, 43 defined by a cutout portion 40, 42, with the inserts 44 being of similar peripheral outline so that each insert 44 may be firmly, but releasably, retained in the appropriate opening through frictional forces. The inserts 44 are formed of filler foam material having a low density less than the intermediate density, the several filler foam materials for a given opening having somewhat different low densities from each other. Both the openings and the inserts are configured and dimensioned for frictional retention of the inserts in the appropriate openings, this frictional retention being enhanced by the provision of corners in the rectangular and square configurations.

It will be appreciated that while at least one, and generally all, of the openings 41 in the intermediate pad 36 will be filled by appropriate inserts 44, the openings 43 in the top pad 38 may be either filled with inserts 44 of left vacant (as shown in FIG. 5); indeed some of openings 43 may be filled and others left vacant. If desired, the insert receiving apertures 43 of the top pad 38 may be aligned vertically with the insert-receiving apertures 41 of the intermediate pad 36 so as to provide the combined effect of two inserts of differing densities or even a double thickness of an insert of a single density for a particular pressure point.

Once the appropriate inserts for the openings 40 have been selected, the various pads and panel 30, 32, 36 and 38 are put back in sequence and in vertical alignment and then, as shown in FIG. 5, replaced within the cover 20, as indicated by the arrow 46. The cover closure means 26 is then used to close the cover aperture 25, and the pad assembly is now ready for use.

It should be understood that although the inserts and apertures shown are generally square or rectangular, the inserts and apertures can be of any shape and size prescribed for a particular patient or condition. For example, as shown by the phantom lines in FIG. 5, the cutout and insert 43' can be of a semicircular or other shape in a location on the cushion to relieve pressure in the area of the scrotum, rectum or spine. Initially, the top layer of the cushion can be used without the insert to provide maximum pressure reduction and, as the patient's condition improves, a lower density and subsequently the same density foam insert can be reinserted in the aperture to distribute the load of the patient over the largest area of the cushion.

Referring now to FIG. 2, if the patient is unsatisfied with the pad assembly thus produced, he has only to open the cover closure means 26 and remove through cover aperture 25 the panel and pads 30, 32, 36 and 38 along with any inserts 44 (not shown in FIG. 2) associated with the upper layers 36, 38. One or more of the inserts 44 may now be removed from one or more of the openings of the upper pads 34 (as shown in FIG. 3) and new inserts 44 of different densities inserted (as shown in FIG. 4) so as to create a modified pad assembly when the panel and pads along with any associated inserts 44 are replaced in the cover 20 (as shown in FIG. 5). Instead of simply trying different inserts 44 within the openings 41 of the intermediate pad 36, as specifically shown in FIGS. 3–5, one may try, alternatively or in addition thereto, various inserts 44 in the openings 43 of the upper pad 38.

Figure 6:
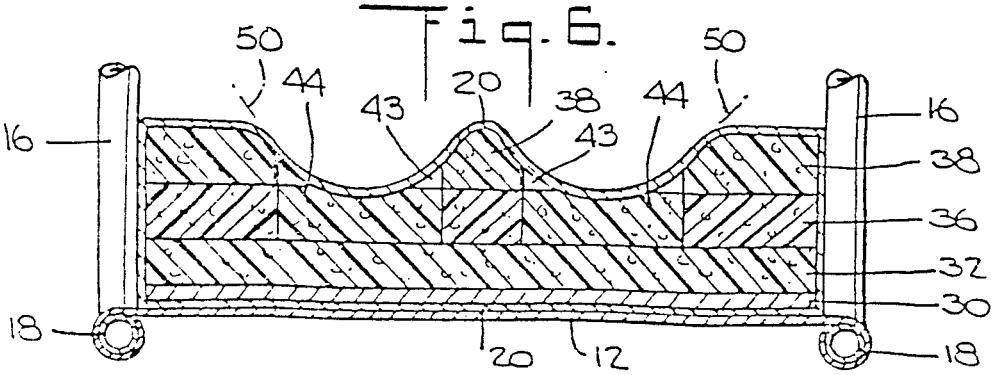
FIG. 6 is a fragmentary rear elevation view showing a pair of buttocks (in phantom-line) seated on the pad assembly mounted in the wheelchair, with portions of the pad assembly being illustrated in section.

Referring now to FIG. 6, therein illustrated is the effect of a patient (represented by buttocks 50) sitting on a pad assembly 10 of the type shown in FIG. 5. The openings 43 of the top pad 38 and the inserts 44 in the openings 41 of the intermediate layer 36 combine to provide a maximum of relief to the pressure points of the buttocks 50.

Figure 7:
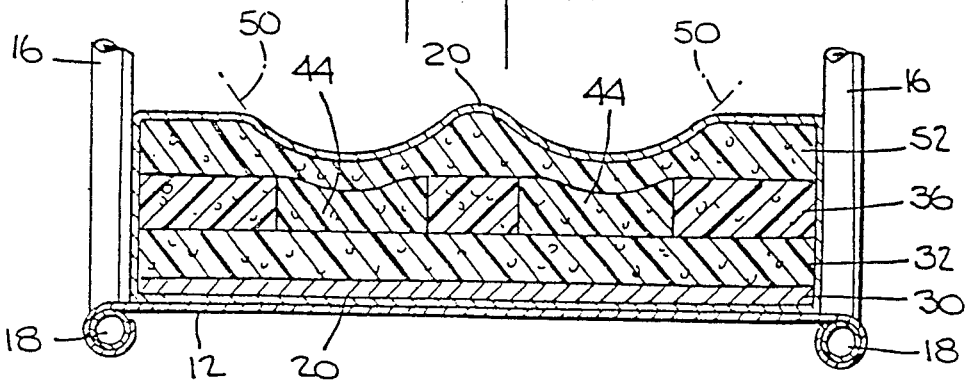
FIG. 7 is a fragmentary rear elevation view, similar to FIG. 6, but showing a variant of the pad assembly.

Referring now to FIG. 7, therein illustrated is a variant pad assembly similar to the pad assembly of FIG. 6 except that there is but a single upper pad 34—namely, pad 36. Instead of a top pad 38 defining at least one aperture 43 (either with or without inserts 44 therein), there is an imperforate pad 52, differing structurally therefrom in the absence of any openings 43 therein. The imperforate pad 52 is not used for gross pressure correction purposes and may be composed of either the same material as an upper pad 34 or an impact foam to provide slow contouring and high air circulation. An impact foam allows maximum air circulation, typically because of a largely open-cell structure, and is preferably a visco-elastic that contours slowly to form-fit to the body, in a manner similar to a gel or fluid. Suitable impact foams include Sunmate (a trademark of Dynamic Systems, Inc. Of North Carolina for its visco-elastic material) and Puggie (a trademarK of the same company for its orthopedic contouring foam).

A kit according to the present invention will include the items indicated in FIG. 5—namely a cover 20, a foundation panel 30, a bottom pad 32, at least one upper pad 34 and a plurality of inserts 44 for each of at least one of the openings in at least one of the upper pads. One or more imperforate pads 52 may also be included.

The various pads may be provided in different thicknesses, for example, 0.5 or 1 inch thicknesses, depending on the needs of the patient, the thickness of the inserts 44 being correspondingly selected. A pad assembly is generally at least 3 inches high, but less than 4 inches.

For those patients who require posture correction because of a tendency to lean to one side, forwards or backwards, a mini-pad (typically a half of a regular sized pad) may be placed immediately atop the bottom pad under the appropriate buttock and/or thigh to raise that area. Such a mini-pad is preferably formed of the same material as a bottom pad—namely, a high density foam, although other materials such as the intermediate density foam may also be used. The kit embodiment of the present invention generally includes at least one such mini-pad.

The kit should further contain any original cutouts 40, 42 created in order to leave openings 41, 43. Thus, if at a later date the problem which require the particular cushioning effect in the area of an opening is no longer required—for example, because the particular problem has disappeared or the pad assembly is used by another person not having that problem—the original cutout 40, 42 can be replaced in the opening 41, 43 to provide a uniformly firm chair pad. In an appropriate situation, certain of the openings may be "closed" by means of original cutouts while other openings are left "open" for to the use of inserts 44.

Depending upon the number of inserts 44 provided for each particular opening, the needs of a patient for an effective firmness of a particularly degree in that opening may be met with reasonable satisfaction. The greater the number of inserts 44 provided, the closer an approximation can be made to the desired firmness. On the other hand, the provision of a great number of inserts 44 increases material cost and requires bulky kits for packaging, shipment and storage (keeping in mind that the various unused inserts should be saved for later use in the event of variations in the patient's condition over time). Accordingly, in a second embodiment of the invention, a variably fillable fluid-tight pouch is used as an insert.

Figure 8:
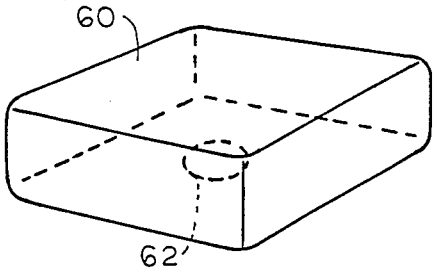
FIG. 8 is an isometric view of a pouch insert according to the present invention.

Referring now to FIG. 8, the second embodiment employs a collapsible pouch 60 useful as an insert 44. The pouch 60 is fluid-tight and is provided with appropriate conventional valve means 62, preferably manually operable, enabling the introduction, maintenance and removal of fluid relative to the pouch. The fluid used in connection with the pouch may be any material which conforms to the walls of the container in which it is held and is preferably air, water, gel or a mixture thereof. Where the pouch is intended to be used in conjunction with a common fluid such as air or water, it may be conveniently shipped in an empty and collapsed state as part of a kit, and then filled to a desirable level by the user. Alternatively, where the pouch is to be filled with a fluid not easily available, such as a gel, the pouch may be shipped in a substantially filled state, the patient upon receipt being able to spill off as much of the fluid as necessary to provide the desired firmness.

Unlike the foam materials, the density of the pouch does not determine its firmness. Rather the material used as the fluid therein and especially the pressure exerted by the fluid outwardly on the pouch walls determines firmness. Such pressure may be varied by varying the quantity of the fluid within the pouch, greater quantities creating higher pressures and lower quantities creating lower pressures in the case of a gas or a liquid which fills the entire inner volume of the pouch. Where the liquid does not entirely fill the interior volume of the pouch, the pouch will collapse as weight is applied to the top therof until the effective inner volume is occupied by the fluid. Gels are generally similar to liquids for the purposes of the present invention although they generally exhibit more comfort for the user. Preferably the pouches are filled with sufficient fluid to enable them to be frictionally mounted within the openings 41, 43 to function appropriately in the present invention. Generally the pouches should be filled to provide a firmness which is less than the firmness of the resilient foam material of intermediate density.

The pouch 60 may be of any three dimensional shape and is preferably configured and dimensioned to be received and frictionally mounted as an insert within the desired opening. The pouch may be used as the insert 44 in a variety of different ways. The pouch 60 may be used as an insert 44 completely filling the aligned openings 41, 43 below a portion of the user requiring lesser pressure. Alternatively, as shown in FIG. 6, the insert 44 formed of the pouch 60 may be used to fill an opening 41 while leaving an opening 43 thereabove. Or, as shown in FIG. 7, the insert 44 formed of pouch 60 may be used to fill an opening 41 while an upper pad 52 of resilient foam material of intermediate density extends thereabove. In addition to these varied uses of the pouch 60 as the sole insert 44 for a given opening or series of openings 41, 43, however, the pouch 60 may be used as an insert in conjunction with other inserts 44 made of filler foam material. In such an instance the height of the pouch, as used, and the height of the filler foam material, must in combination enable both the pouch and the filler foam material to be received one atop the other within the intended opening or series of vertically aligned openings. (This fit is assured if the two pouches fit within the opening(s) even when the pouch is substantially filled with fluid). The pouch insert 60 may be used above or below the filler foam material insert 44 as necessary in order to provide whatever firmness is most suitable for the particular patient at that particular location. Generally, it has been found the whenever a pouch insert is used, whether alone or in conjunction with filler foam material inserts, it is generally desirable to allow a little open space at the top of the opening 43 to reduce pressure development.

Figure 9:
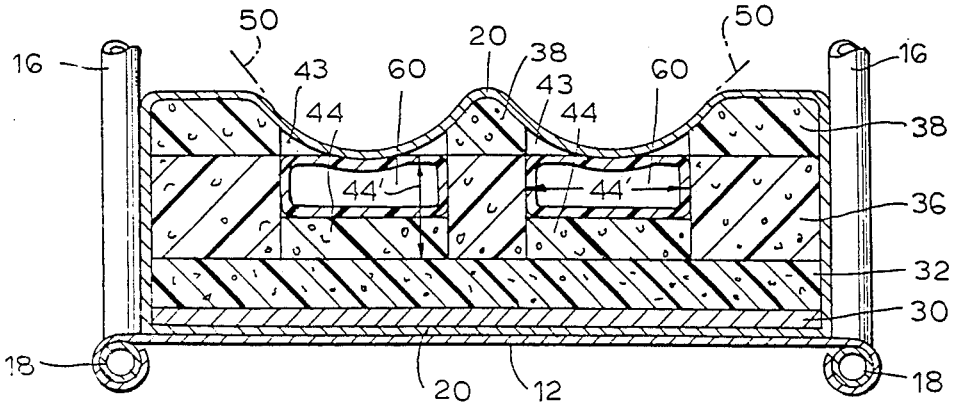
FIG. 9 is a fragmentary rear elevation view similar to FIG. 6, but showing the composite inserts composed of a pouch insert and foam cushion insert.

Referring now to FIG. 9, therein illustrated is a pad assembly similar to the pad assembly of FIG. 6 except that intermediate pad 36 is drawn to an enlarged thickness scale for illustrative purposes and, instead of a single insert 44 in the opening 41, there is a combination insert or construct 44'. The bottom portion of the construct is formed of filler foam material of low density, and the upper portion is formed of an insert of pouch 60. As in FIG. 6, the top of the opening 43 is not occupied any insert. Clearly the construct 44' could alternatively be formed of the two inserts in reverse order. Furthermore, while the filler foam material insert 44 and the pouch insert 60 are preferably separate entities, as shown, they may also be joined together in construct 44' for movement as a unit.

Use of the pouch 60 as an insert, either alone or in combination with filler foam inserts, affords certain advantages over the use of filler foam material inserts alone. The effective firmness of the insert may be varied finely through trial and error over-filling or under-filling of the pouch until just the right firmness for the particular patient at the particular location is achieved. This not only permits the user the optimum in a therapeutic comfort, but allows the same be be provided by a kit with far fewer or no filler foam material inserts for shipment, handling and storage.

To summarize, the pressure distribution pad assembly of the present invention enables the density of the filler foam material in the pad openings to be easily varied either initially after receipt from the factory to meet the particular needs of the individual user or over time in order to meet the changing requirements of the individual user. The kit embodiment of the present invention enables such assemblies to be easily constructed and modified by the user outside of the factory.

Now the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

What is claimed is:

1. A modifiable pressure distribution pad assembly for a wheelchair comprising:

(A) a bottom pad of resilient foam material of high density;

(B) at least one upper pad of resilient foam material of an intermediate density less than said high density, said upper pad being supported by said bottom pad and having at least one cutout defining an opening therethrough;

(C) a fluid-tight pouch at least partially filled with fluid frictionally mounted as an insert in at least one of said openings of at least one of said upper pads and removable therefrom, said pouch insert having a firmness less than that of said at least one upper pad; and (D) a cover enclosing said pads, said cover permitting removal of said upper pad and associated pouch insert therefrom so that said pouch insert in said at least one opening can be separated from said upper pad, the amount of fluid in said pouch insert varied to modify the firmness thereof, and said pouch insert replaced in said at least one opening prior to return of said upper pad and associated pouch insert to said cover.

2. The pad assembly of claim 1 wherein said fluid is selected from the group consisting of air, water, gel and mixtures thereof.

3. The pad assembly of claim 1 wherein said pouch insert contains manually operable valve means to permit the introduction, maintenance and removal of fluid relative to said pouch insert.

4. The pad assembly of claim 1 additionally comprising filler foam material frictionally mounted as an insert in said at least one opening with said pouch insert and removable therefrom, said filler foam material having a low density less than said intermediate density, said pouch insert when substantially filled with fluid and said filler foam material insert having combined heights enabling both inserts to be received one atop the other within said at least one opening, and said cover permitting removal of said upper pad and associated inserts therefrom so that said inserts in said at least one opening can be separated from said upper pad and replaced in said one opening by inserts of a different effective combined firmness prior to return of said upper pad and associated inserts to said cover.

5. A kit for preparing an individualized and modifiable pressure distribution pad assembly for a wheelchair comprising:

(A) a bottom pad of resilient foam material of high density;

(B) at least one upper pad of resilient foam material of an intermediate density less than said high density, said upper pad having at least one cutout defining an opening therethrough and being adapted to be supported by said bottom pad;

(C) for said at least one opening, a plurality of inserts adapted to be removably mounted in said at least one opening, at least one of said inserts being of filler foam material having a low density less than said intermediate density, and at least one of said inserts being a fluid-tight pouch adapted to be filled with fluid; and (D) a cover adapted to enclose said pads, said cover permitting insertion into and removal from said cover of said upper pad and those of said inserts mounted in said opening thereof.

6. The kit of claim 5 wherein said fluid is selected from the group consisting of air, water, gels and mixtures thereof.

7. The kit of claim 5 wherein said pouch insert contains manually operable valve means to permit the introduction, maintenance and removal of fluid relative to said pouch insert.

8. The kit of claim 5 wherein said pouch insert and said at least one filler foam material insert have heights enabling both said pouch insert, when substantially filled with fluid, and said at least one filler foam material to be received insert one atop the other within said at least one opening.

9. The kit of claim 5 wherein one of said filler foam material inserts is said cutout.

* * * * *